United States Patent [19]

Ringgenberg

[11] Patent Number: 4,665,983

[45] Date of Patent: May 19, 1987

[54] FULL BORE SAMPLER VALVE WITH TIME DELAY

[75] Inventor: Paul D. Ringgenberg, Duncan, Okla.

[73] Assignee: Halliburton Company, Duncan, Okla.

[21] Appl. No.: 848,428

[22] Filed: Apr. 3, 1986

[51] Int. Cl.[4] ..... E21B 47/00

[52] U.S. Cl. ..... 166/250; 166/264

[58] Field of Search ..... 166/250, 336, 264, 165, 166/166, 319, 323; 73/151, 152, 155

[56] References Cited

U.S. PATENT DOCUMENTS

| | | | |
|---|---|---|---|
| Re. 29,562 | 3/1978 | Wray et al. | 166/336 |
| Re. 29,638 | 5/1978 | Nutter | 166/128 X |
| 3,850,250 | 11/1974 | Holden et al. | 166/374 |
| 3,858,649 | 1/1975 | Wray et al. | 166/374 |
| 3,915,228 | 10/1975 | Giebeler | 166/321 |
| 3,970,147 | 7/1976 | Jessup et al. | 166/374 X |
| 4,047,564 | 9/1977 | Nix et al. | 166/334 X |
| 4,063,593 | 12/1977 | Jessup | 166/317 |
| 4,064,937 | 12/1977 | Barrington | 166/321 X |
| 4,083,409 | 4/1978 | Barrington | 166/320 |
| 4,109,725 | 8/1978 | Williamson et al. | 166/373 |
| 4,113,012 | 9/1978 | Evans et al. | 166/321 X |
| 4,258,793 | 3/1981 | McGraw et al. | 166/374 |
| 4,270,610 | 6/1981 | Barrington | 166/317 |
| 4,311,197 | 1/1982 | Hushbeck | 166/373 |
| 4,328,866 | 5/1982 | Zimmerman | 166/317 |
| 4,355,685 | 10/1982 | Beck | 166/331 X |
| 4,417,622 | 11/1983 | Hyde | 166/264 |
| 4,422,506 | 12/1983 | Beck | 166/324 |
| 4,429,748 | 2/1984 | Beck | 166/324 |
| 4,448,254 | 5/1984 | Barrington | 166/373 |
| 4,489,786 | 12/1984 | Beck | 166/374 |
| 4,502,537 | 3/1985 | Carter, Jr. | 166/332 X |
| 4,515,219 | 5/1985 | Beck | 166/374 |
| 4,553,598 | 11/1985 | Meek et al. | 166/317 |
| 4,579,174 | 4/1986 | Barrington | 166/373 X |
| 4,597,439 | 7/1986 | Meek | 166/264 X |

FOREIGN PATENT DOCUMENTS

| | | |
|---|---|---|
| 2132250 | 7/1984 | United Kingdom . |

*Primary Examiner*—Stephen J. Novosad
*Assistant Examiner*—Thuy M. Bui
*Attorney, Agent, or Firm*—Joseph A. Walkowski

[57] ABSTRACT

A sampler valve including a tubular housing defining a cylindrical chamber of enlarged diameter in comparison to the remainder of the full bore extending through the valve, an axially slidable sample chamber mandrel adapted to span the length of the enlarged diameter chamber in a sealing manner to thereby create an annular sample chamber while simultaneously trapping a fluid sample therein, and drain means to remove a trapped sample from the sample chamber. The sample chamber mandrel is operated by a power mandrel responsive to a predetermined level of well annulus pressure surrounding the sampler valve, the power mandrel being initially secured in place against axial movement by shear means shearable at the aforesaid predetermined pressure. A time-delay means to retard the movement of the power mandrel after shearing of the shear means is also included.

19 Claims, 8 Drawing Figures

FULL BORE SAMPLER VALVE WITH TIME DELAY

BACKGROUND OF THE INVENTION

The present invention relates to an improved annulus pressure responsive sampling apparatus for use in the sampling of well formation fluids in the testing of oil wells.

Various tester valves, circulation valves and sampler valves for testing oil wells have been developed which are responsive to changes in the annulus pressure of the fluid between the well bore and the testing string for the opening and closing of the various valves. These various annulus pressure responsive valves are useful, particularly in offshore testing operations, where it is desired to manipulate the various valves in the testing string without utilizing reciprocation of the testing string thereby allowing the blow-out preventers to remain closed about the testing string.

Typical prior art annulus pressure responsive valves which may be used as sampler valves for obtaining a sample of the formation fluids during the formation testing procedure are described in U.S. Pat. Nos. RE 29,562; RE 29,638; 3,858,649; 4,047,564; 4,063,593; 4,064,937; 4,270,610; 4,311,197; 4,502,537; 4,553,598; and in United Kingdom Patent Application GB No. 2132250A.

In wells where high formation pressures and flow rates are encountered along with sour gas, hydrogen sulfide ($H_2S$), being present it is desirable to have an annulus pressure responsive sampler valve which is designed to catch and retrieve samples of formation fluids under such conditions. It is further desirable to have an annulus pressure responsive sampler valve which has an unrestricted bore therethrough after catching a sample of formation fluids so that formation fluids recovered during testing operations may be injected back into the formation or other operations may occur as desired. This is particularly desirable in environmentally sensitive areas where the surface disposal of formation fluids is a problem or prohibited. Moreover, the desirability of maintaining an open, unrestricted bore through a sampler valve is not limited to the above situations, but is generally desirable so that, even if the sampling mechanism is accidentally, inadvertently or even intentionally actuated before or during a test, the test may still continue. The aforesaid U.S. Pat. No. 4,502,537 discloses a valve which attempts to provide this capability. However, that sampler valve does not have a truly unrestricted bore, as the diameter thereof is less than that of normally used tester valves, sampler valves, and other tools employed in a testing string. As a consequence, perforating guns cannot be run through that sampler valve on a wireline, nor can actuating means for tubing conveyed perforating guns be dropped therethrough. In addition, that sampler valve requires the fluid to be sampled to travel through restrictive apertures at the top and bottom of an annular sample chamber in the wall of the tool. Moreover, the actuation of this prior art sampler valve is substantially instantaneous in response to the appropriate level of annulus pressure, thus prohibiting sampling after a time delay, such as after a tester valve thereabove has been closed. Finally, this prior art valve is unduly complex in structure, particularly in the means employed to drain the sample chamber after a test.

STATEMENT OF THE INVENTION

The present invention is directed to a full bore annulus pressure responsive sampler valve for use in the sampling of formation fluids in the testing of oil wells, i.e., wherein formation fluids include both liquids and gases.

The sampler valve of the present invention includes a tubular housing defining a cylindrical chamber of enlarged diameter in comparison to the remainder of the full bore extending through the valve, an axially slidable sample chamber mandrel adapted to span the length of the enlarged diameter chamber in a sealing manner to thereby create an annular sample chamber while simultaneously trapping a fluid sample therein, and drain means to remove a trapped sample from the sample chamber. The sample chamber mandrel is operated by a power mandrel responsive to a predetermined level of well annulus pressure surrounding the sampler valve, the power mandrel being initially secured in place against axial movement by shear means shearable at the aforesaid predetermined pressure. A time-delay means to retard the movement of the power mandrel after shearing of the shear means is also included.

BRIEF DESCRIPTION OF THE DRAWINGS

The advantages of the present invention will be more fully understood from the following description and drawings wherein.

OVERALL WELL TESTING ENVIRONMENT

Figure 1:
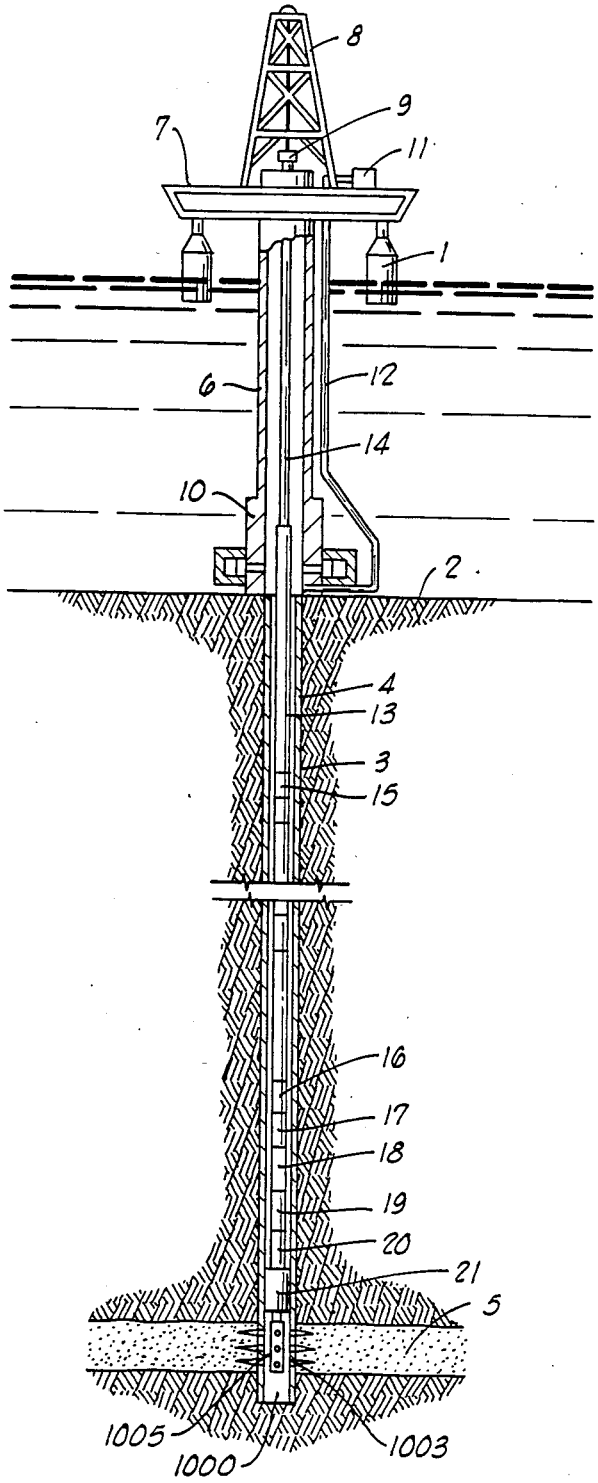
FIG. 1 provides a schematic vertically sectioned view of a representative offshore installation which may be employed for testing purposes and illustrates a formation testing "string" or tool assembly in position in a submerged wellbore and extending upwardly to a floating operating and testing station.

Referring to FIG. 1 of the present invention, a testing string for use in an offshore oil or gas well is schematically illustrated.

In FIG. 1, a floating work station 1 is centered over a submerged oil or gas well located in the sea floor 2 having a wellbore 3 which extends from the sea floor 2 to a submerged formation 5 to be tested. The wellbore 3 is typically lined by steel casing 4 cemented into place. A subsea conduit 6 extends from the deck 7 of the floating work station 1 into a wellhead installation 10. The floating work station 1 has a derrick 8 and a hoisting apparatus 9 for raising and lowering tools to drill, test, and complete the oil or gas well.

A testing string 14 is being lowered in the wellbore 3 of the oil or gas well. The testing string includes such tools as one or more pressure balanced slip joints 15 to compensate for the wave action of the floating work station 1 as the testing string is being lowered into place, a circulation valve 16, a tester valve 17 and the sampler valve of the present invention 18. Of course, as will be explained in more detail hereafter, the relative positions of tester valve 17 and sampler valve 18 in the testing string 14 may be reversed.

The slip joint 15 may be similar to that described in U.S. Pat. No. 3,354,950 to Hyde. The circulation valve 16 is preferably of the annulus pressure responsive type and may be as described in U.S. Pat. Nos. 3,850,250 or 3,970,147. The circulation valve 16 may also be the recloseable type as described in U.S. Pat. No. 4,113,012 to Evans et al.

The tester valve 17 is preferably of the type disclosed in U.S. Pat. No. 4,429,748, although other annulus pressure responsive tester valves as known in the art may be employed.

A check valve 19 as described in U.S. Pat. No. 4,328,866 which is annulus pressure responsive may be located in the testing string below the sampler valve 18 of the present invention.

The tester valve 17, circulation valve 16 and check valve 19 are operated by fluid annulus pressure exerted by a pump 11 on the deck of the floating work station 1. Pressure changes are transmitted by a pipe 12 to the well annulus 13 between the casing 4 and the testing string 14. Well annulus pressure is isolated from the formation 5 to be tested by a packer 21 set in the well casing 4 just above the formation 5. The packer 21 may be a Baker Oil Tools Model D packer, the Otis type W packer, the Halliburton Services EZ Drill ® SV packer or other packers well known in the well testing art.

The testing string 14 includes a tubing seal assembly 20 at the lower end of the testing string which "stings" into or stabs through a passageway through the production packer 21 for forming a seal isolating the well annulus 13 above the packer 21 from an interior bore portion 1000 of the well immediately adjacent the formation 5 and below the packer 21.

Check valve 19 relieves pressure built up in testing string 14 below tester valve 17 as seal assembly 20 stabs into packer 21.

A perforating gun 1005 may be run via wireline to or may be disposed on a tubing string at the lower end of testing string 14 to form perforations 1003 in casing 4, thereby allowing formation fluids to flow from the formation 5 into the flow passage of the testing string 14 via perforations 1003. Alternatively, the casing 4 may have been perforated prior to running testing string 14 into the wellbore 3.

A formation test controlling the flow of fluid from the formation 5 through the flow channel in the testing string 14 by applying and releasing fluid annulus pressure to the well annulus 13 by pump 11 to operate circulation valve 16, tester valve 17, sampler valve 18 and check valve 19 and measuring of the pressure buildup curves and fluid temperature curves with appropriate pressure and temperature sensors in the testing string 14 is fully described in the aforementioned patents.

DETAILED DESCRIPTION OF THE PREFERRED EMBODIMENT

Sampler valve 18 of the preferred embodiment of the present invention generally comprises a housing assembly 100 surrounded by a mandrel assembly 102, with initiation means 103 disposed therebetween.

At the top of housing assembly 100 is top coupling 104, having generally cylindrical exterior surface 106. The interior of top coupling 104 comprises entry bore 108 defined by box threads 110, below which annular shoulder 112 protrudes inwardly. At the bottom of shoulder 112 is radially flat annular surface 114, which terminates at cylindrical bore wall 116, extending downward to a second radially flat annular surface 118, which in turn terminates at a second abbreviated cylindrical bore 120. Seal bore 122 having seal recess 124 therein lies below bore 120, and threaded lower bore 126 extends below seal bore 122 to the bottom of top coupling 104.

Cylindrical sample chamber case 130 lies below top coupling 104 and external threads 132 thereon are made up with threaded lower bore 126 of top coupling 104. Leading annular edge 134 of sample chamber case 130 extends upwardly into top adapter 104 beyond lower bore 126, and sealing surface 136 on annular edge 134 is sealingly engaged by seal 138 carried in seal recess 124 of top coupling 104. Radially inward of threads 132 and seal surface 136 lies upper sampler seal bore 140, of cylindrical configuration. Seal bore 140 possesses a plurality of recesses 142 in the wall thereof, each of which carries a seal means 144. Tubular protector sleeve 146 is located in sampler seal bore 140 as sampler valve 18 is run into the wellbore as a part of the testing string. Protector sleeve 146 includes cylindrical exterior surface 148 and cylindrical interior surface 150. Exterior surface 148 possesses an annular recess 152 at the upper extent thereof, and the wall of protector sleeve 146 is pierced by apertures 154 to prevent fluid lock during sleeve movement and to prevent extrusion of seal means 144 due to pressure differentials. A plurality of arcuate locking dogs 156, disposed in a recess created between surface 118 and abbreviated bore 120 of top coupling 104 and leading edge 134 of sample chamber case 130 are inwardly biased into recess 152 of protector sleeve 146 by garter spring 158. In such a manner premature movement of protector sleeve 146 is prevented, such as might be caused by the flow of formation fluids or well treating fluids through the testing string and thus through sampler valve 18.

Below bore 140 of sample chamber case 130, tapered outwardly extending frustoconical surface 160 leads to cylindrical sample chamber bore 162 of greater diameter than bore 140. Sample chamber bore 162 extends downwardly to a second radially inwardly tapered frustoconical surface 164, which terminates at cylindrical lower sample chamber seal bore 166. Lower seal bore 166 includes a plurality of annular recesses 168 in which seal means 170 reside.

Frustoconical surface 164 and the trailing edge of cylindrical sample chamber bore 162 are pierced by two diametrically opposed sample bores 172, both of which are oriented at a slight angle to the axial bore of sampler valve 18. Disposed within each sample bore 172 is a rod-like sample valve 174, which has two sets of O-ring seals 176 and 178 disposed about its exterior surface. Retainer lips 180 at the outward end of sample valves 174 are disposed in notches 182 in sample chamber case 130 to prevent inward movement of sample valve 174, and is maintained in notch 182 by drain valve retainer collar 184 having threads 186 on the interior thereof, which threads mate with external threads 188 on sample chamber case 130, thus clamping retainer lips 180 in place. When it is desired to back off sample valves 174, this may be done by backing off retainer collar 184, whereupon sample valves 174 can be moved into slots 190, which are extensions of notches 182 and are circumferentially aligned with sample bores 172 and are oriented at the same angle as the former. Rotation of retainer collar 184 with respect to sample valves 174 is assisted by brass sleeve 185 disposed in undercut 187 at the upper end of collar 184, which acts as a bushing between retainer lips 180 and collar 184 as the latter is backed off. When valves 174 are backed out of sample bores 172, fluid from the interior of sampler valve 18 may exit through radial drain ports 190 in the wall of sample chamber case 130. Drain ports 190 open onto flats 192 cut in the generally cylindrical surface 194 of sample chamber case 130. The purpose of flats 192 and a preferred procedure for draining a fluid sample from sampler valve 18 will be explained hereafter in conjunction with the operation of the present invention.

Below sample chamber case 130 of housing assembly 100 lies air chamber case 200, of generally tubular configuration. Air chamber case 200 possesses a generally cylindrical exterior surface 202 through which a plurality of oil fill ports 204 extend, these being normally plugged by plugs 206 after valve 18 is filled with silicone oil, the purpose of which is explained hereafter. At the upper end of air chamber case 200, threaded entry bore 208 mates with threads 188 on the lower exterior of sample chamber case, whereby sample chamber case 130 and air chamber case 200 are connected. A seal is effected between these two components by seal means 210 disposed in a seal recess 212 below threaded entry bore 208, seal means 210 bearing against exterior trailing seal surface 214 on the trailing edge of sample chamber case 130. Air chamber bore 216 continues downwardly below seal means 210 to radially flat annular shoulder 218, which extends radially outward to cylindrical shear set bore 220, which itself continues to the lower end of air chamber case 200 where threaded exit bore 222 is located. Immediately above exit bore 222, several power ports 224 extend through the wall of air chamber case 200.

Bottom nipple 230 is secured to air chamber case 200 via external threads 232 on its upper exterior, which mate with threaded exit bore 222 on air chamber case 200. A seal between these two components is effected by O-ring 234 sealing against the wall of shear set bore 220. The exterior of bottom nipple 230 is generally of cylindrical configuration, and terminates at radially flat shoulder 236, below which are disposed pin threads 238. The interior of bottom nipple 230 is defined by an upper seal bore 242, which carries a plurality of recesses 244 in which are disposed seal means 246. Below seal bore 242, mandrel bore 248 of slightly larger diameter extends downward to lower chamfered bore 250, extending gradually inward to exit bore 252 at the bottom of bottom nipple 230.

Housing assembly 100 thus comprises top coupling 104, sample chamber case 130, protector sleeve 146, sampler valves 174, retainer collar 184, air chamber case 200, and bottom nipple 230.

Figure 2A:
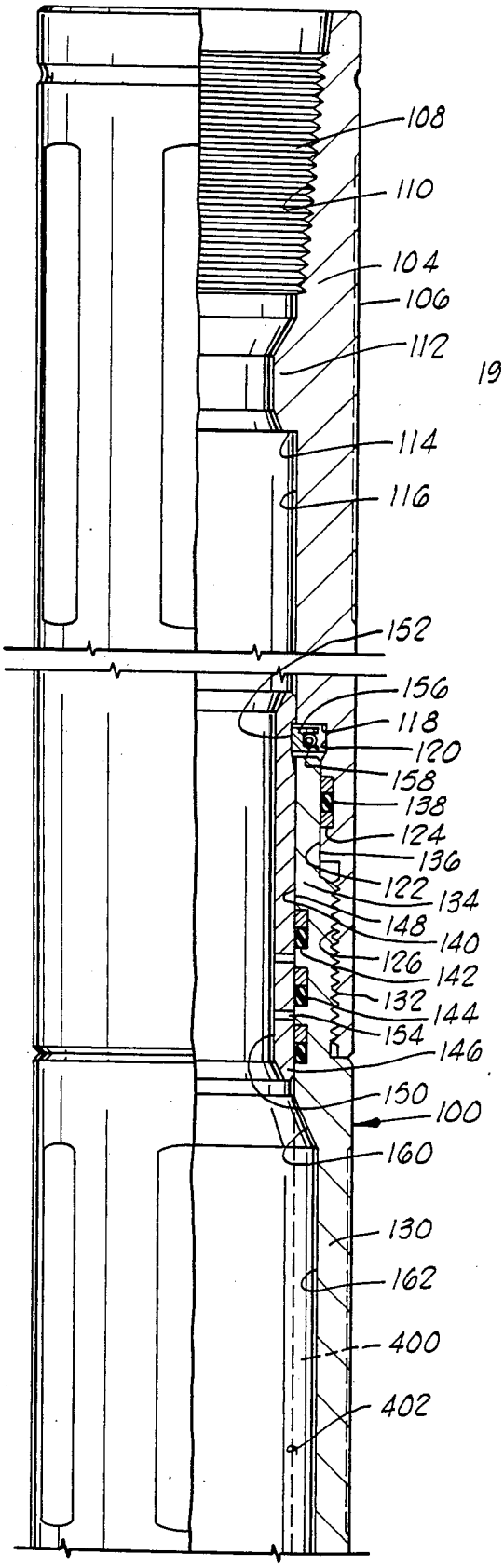
FIGS. 2A–2E comprise a vertical quarter-section elevation of the sampler valve of the present invention.
Figure 2B:
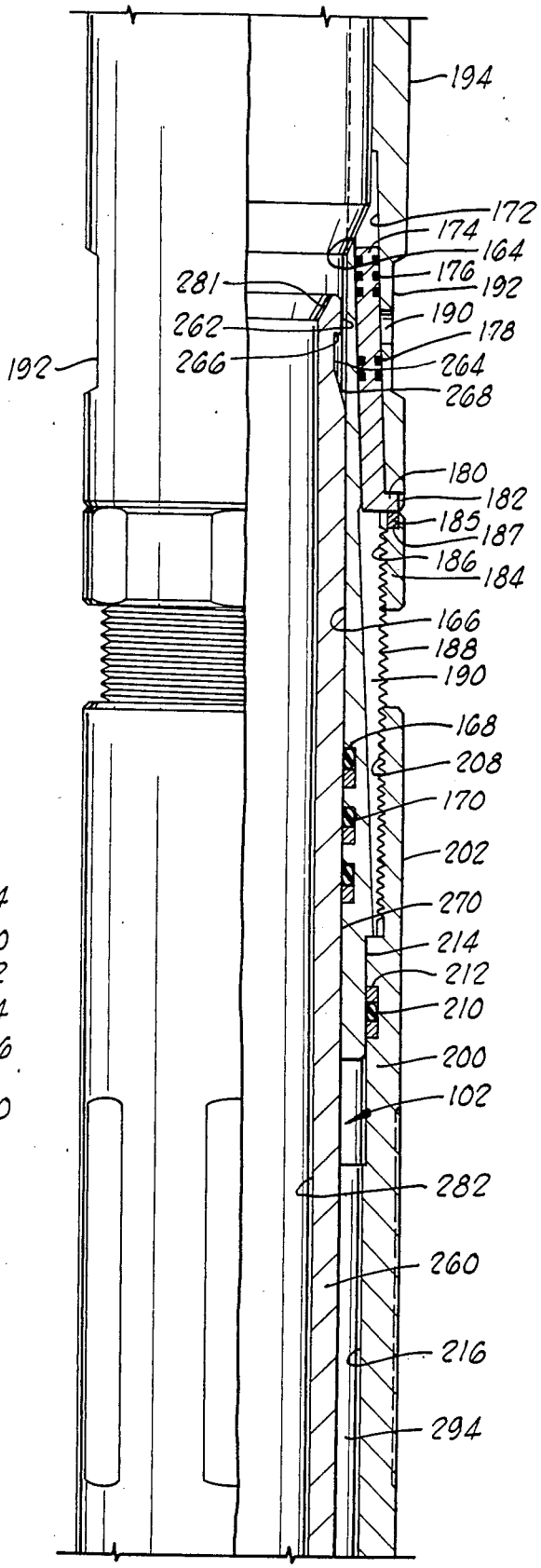
Figure 2C:
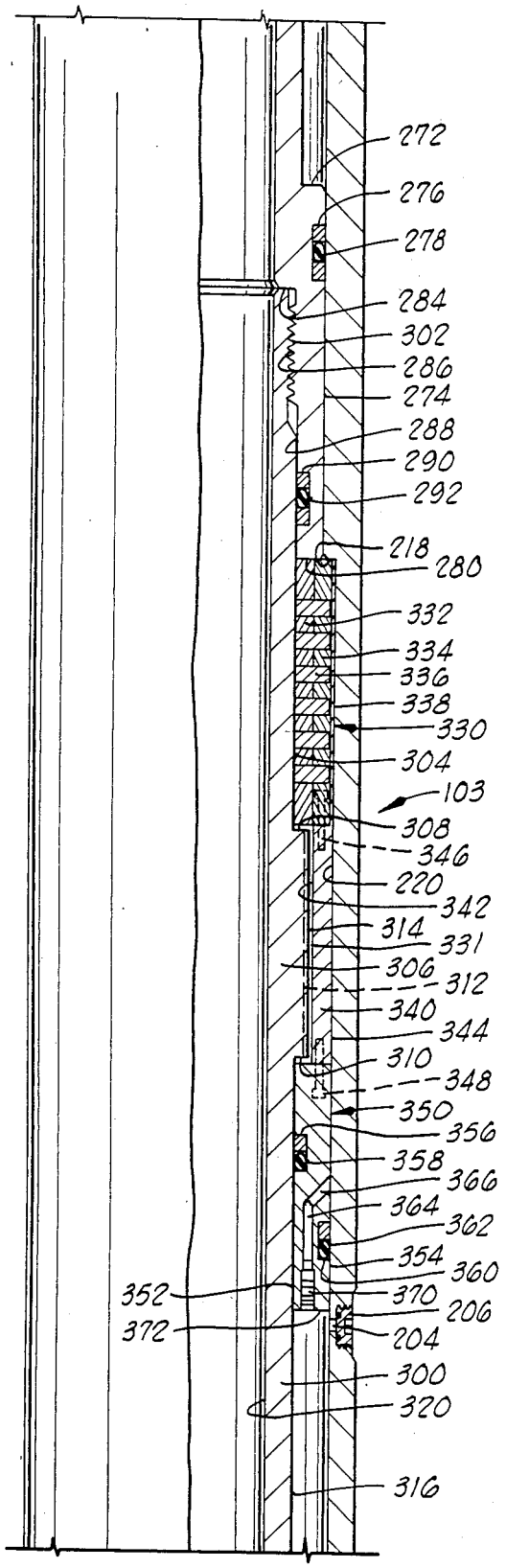
Figure 2D:
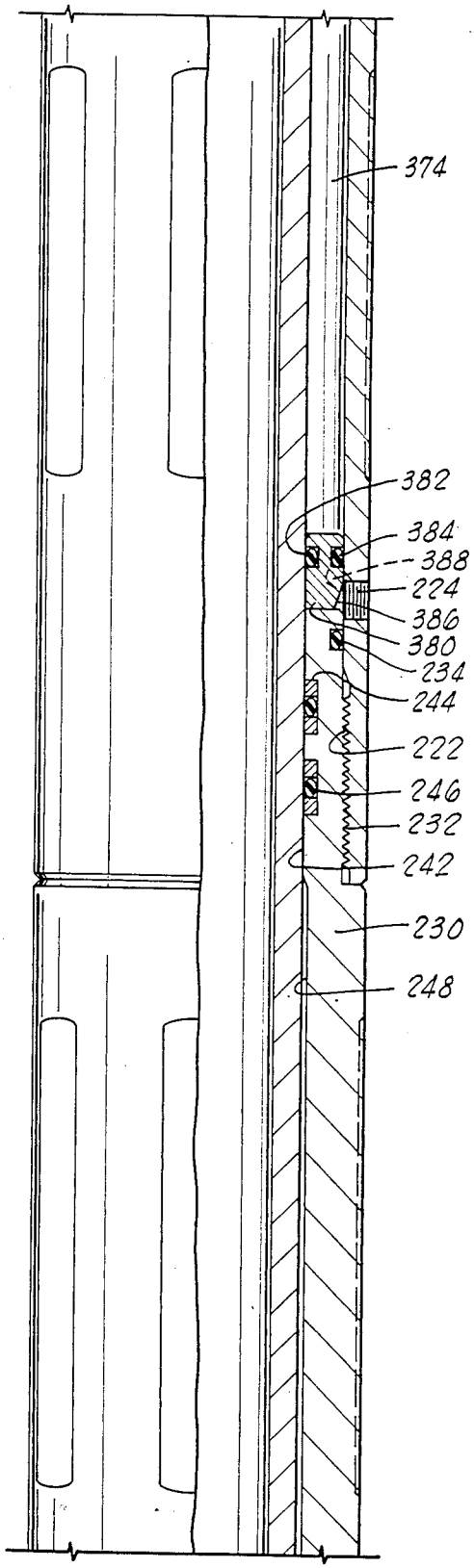
Figure 2E:
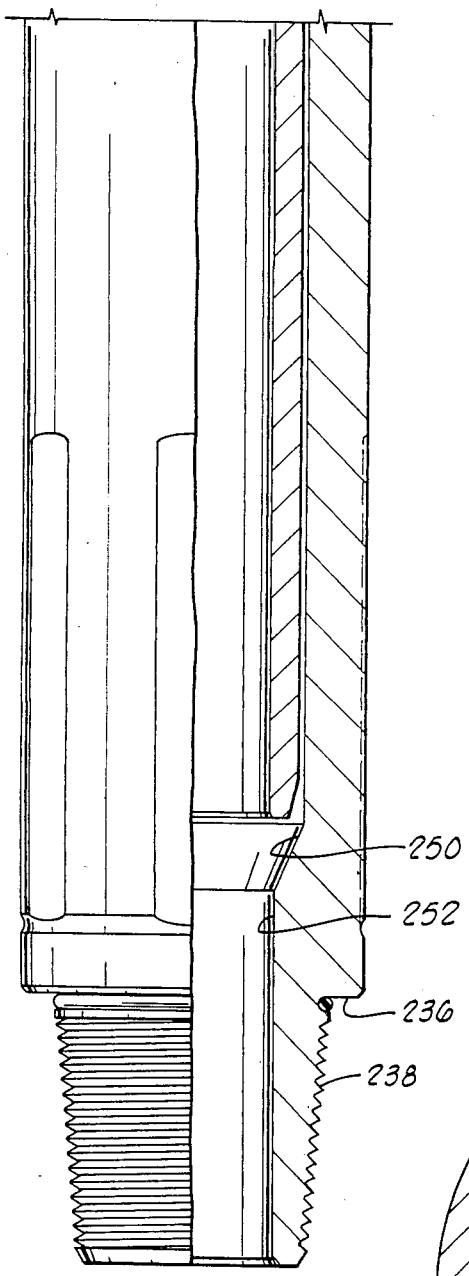

Returning to FIG. 2B, mandrel assembly 102 includes sample chamber mandrel 260 at the top thereof. Sample chamber mandrel 260 is generally tubular in configuration, and the exterior thereof is defined by a generally cylindrical leading edge, below which is annular recess 264 having a radially flat upper edge 266 and a gently tapered lower annular edge 268, which extends to cylindrical exterior surface 270. Surface 270 terminates at radially flat annular shoulder 272 which in turn extends outwardly to a second, larger cylindrical surface 274. At the bottom of mandrel 260 is radially flat trailing piston edge 280. The interior of mandrel 260 includes chamfered entry bore 281, which extends to cylindrical mandrel bore 282, bore 282 terminating at annular shoulder 284 below which is threaded cylindrical bore 286. Cylindrical seal bore 288 having annular recess 290 therein extends to trailing piston edge 280, recess 290 containing therein seal means 292.

An annular low pressure chamber 294 is defined between the lower end of sample chamber case 130, the interior bore 216 of air chamber case 200, the cylindrical exterior 270 of sample chamber mandrel 260, and annular shoulder 272 of sample chamber mandrel 260. Chamber 294 is variable in length, depending on the position of sample chamber mandrel 260. Chamber 294 is generally filled with air at atmospheric temperature and pressure when sampler valve 18 is assembled, and seal means 170, 210 and 278 prevent leakage thereinto as the tool encounters increased pressures when it is run into the hole and when tests and treatments are conducted through it. The air in chamber 294 thus provides a large pressure differential to induce movement of sample chamber mandrel 260 upon application of pressure at the exterior of sampler valve 18, as will be more fully explained hereafter.

Tubular oil chamber mandrel 300 is secured to sample chamber mandrel 260 via the engagement of external cylindrical threaded surface 302 with threaded bore 286 of mandrel 260. Below surface 302, cylindrical surface 304 extends to annular ledge 306, which is defined by upper and lower radially extending edges 308 and 310 respectively. A plurality of shallow longitudinally extending grooves 312 are disposed in cylindrical exterior surface 314 of ledge 306, grooves 312 extending between edges 308 and 310. Below ledge 306, a second cylindrical surface 316 of like diameter to surface 270 on sample chamber mandrel 260 extends to the lower end of oil chamber mandrel 300. The interior of mandrel 300 is defined by cylindrical bore 320 which extends from the top to the bottom thereof. At the top of mandrel 300, a fluid tight seal is effected between mandrel 300 and sample chamber mandrel 260 by seal means 292 bearing upon cylindrical surface 304.

Sample chamber mandrel 260 and oil chamber mandrel 300 comprise mandrel assembly 102.

A shear set 330 is disposed between air chamber case 200 and oil chamber mandrel 300 in an annular cavity 331 defined at the top by shoulder 218 on the interior of air chamber case 200 and trailing piston edge 280 at the lower end of sample chamber mandrel 260, on the outside by cylindrical bore 220 of air chamber case 200 and on the inside by cylindrical surface 304 on oil chamber mandrel 300. Annular ledge 306 narrows the aforesaid cavity 331 while metering cartridge 350, described below, provides a lower boundary therefor.

Shear set 330 includes concentric inner and outer tubular shear supports 332 and 334, respectively, a plurality of brass shear pins 336 which extend through radially aligned apertures (unnumbered) in the shear supports, and a shear set cover or sleeve 338 which surrounds shear set 330 and maintains pins 336 in their supports and against surface 304 of mandrel 300. Outer support 334 is secured at its lower edge to annular quick slap connector 340 by a plurality of longitudinally oriented circumferentially disposed bolts 342, which lie in recesses (not shown) in outer shear support 334 and are threaded to connector 340. Connector 340 extends about ledge 306 on mandrel 300 longitudinally downward to metering cartridge 350, to which it is secured in a manner similar to that described above by a second plurality of longitudinally oriented circumferentially disposed bolts 348.

Metering cartridge 350 comprises an annular collar having cylindrical interior and exterior edges 352 and 354, respectively. Interior surface 352 accommodates annular recess 356 therein, in which is disposed seal means 358. Likewise, exterior surface 354 accommodates an annular recess 360, in which is disposed seal means 362. Several longitudinally oriented metering bores 364 extend partially through metering cartridge 350 from the bottom thereof upwardly. Metering bores 364 are intersected by oblique bores 366 which extend to exterior surface 354. A fluid metering device 370, such as is disclosed in U.S. Pat. No. 3,323,550, and is sold under the trade name of Lee Visco Jet, is disposed in each longitudinal metering bore 364 at the lower end thereof.

Below metering cartridge 350 lies annular oil chamber 374, which is defined by the lower end 372 of metering cartridge 350, on the outside by cylindrical bore 220 of air chamber case 200, on the inside by cylindrical surface 316 of oil chamber mandrel 300, and at the lower end by sliding annular piston 380. Oil chamber 374 is normally filled prior to running a test with a suitable fluid, such as 50 centistoke silicone oil, through fill ports 204, which are subsequently plugged by plugs 206. When chamber 374 is completely filled, floating piston 380 will bottom out against the top of bottom nipple 230 adjacent power ports 224, which extend through the wall of case 200.

Floating piston 380 is in slidable sealing engagement with bore 220 and mandrel surface 316, a sliding seal being effected by inner and outer O-rings 382 and 384, respectively, which are disposed in annular recesses (unnumbered). Trailing edge 386 of piston 380 is tapered, so as to assure the action of hydrostatic pressure through power ports 224 upon piston 380. In addition, several pockets 388 are milled in trailing edge 386, pockets 388 communicating with the outer annular recess in which O-ring 384 is disposed. If the sampler valve 18 is disposed in a hot well which causes expansion of and a pressure increase in the silicone oil before hydrostatic pressure causes floating piston 380 to move upwardly in chamber 374, internal oil pressure in chamber 374 will displace sections of O-ring 384 downward into pockets 388, venting oil to the well annulus through power ports 224. When the pressure is equalized, O-ring 384 will return to its normal position. Thus, the O-ring 384 in combination with slots 388 act as a check or bypass valve with respect to excess pressure in chamber 374.

Low pressure chamber 294, piston edge 280, shear set 330, quick slap connector 340, metering cartridge 350, the oil in chamber 374 and floating piston 380 comprise initiation means 103.

OPERATION OF THE PREFERRED EMBODIMENT

Returning to FIG. 1 of the drawings, it will be assumed that a drill stem test has been or is being conducted using testing string 14 in a manner well known in the art, by alternately flowing and closing in the well through tester valve 17 by cycling pressure in well annulus 13.

When it is desired to obtain a sample of formation fluid from formation 5 with sampler valve 18, a predetermined amount of pressure is applied to well annulus 13 to operate valve 18 as follows. Well annulus pressure enters sampler valve 18 through power ports 224, acting upon floating piston 380. Floating piston 380 in turn transmits the annulus pressure to chamber 374, filled with silicone oil, where the pressure moves through metering device 370, metering bore 364, oblique bore 366 to the outer surface 354 of metering cartridge 350. Since the exit of oblique bore 366 is above seal means 362, the pressure enters cavity 331 above metering cartridge 350 in the vicinity of quick stop connector 340 and, unrestrained by any seal means, travels past shear set 330 to act upon piston edge 280 of sample chamber mandrel 260.

When the force on piston edge 280 is of sufficient magnitude, shear pins 336 are sheared by the shear force caused by ledge 306 acting on inner shear support 332 and the restraining effect of shoulder 218 on outer shear support 334. The magnitude of the force required is readily variable and, of course, dependent upon the material composition, diameter and number of shear pins 336 employed by the operator. It is generally preferable to employ a shear force high enough to require a well annulus pressure at least several hundred psi higher than that required to operate tester valve 17, so as to prevent inadvertent operation of sampler valve 18.

At such time as pins 336 shear, upward movement of mandrel assembly 102 relative to housing assembly 100 is impeded or delayed due to the presence of metering cartridge 350 between air chamber case 200 and oil chamber mandrel 300. In order for the oil in chamber 374 to enter the enlarging cavity 331 as mandrel assembly 102 moves upwardly with respect to housing assembly 100, the oil in chamber 374 must pass through metering device 370, which slows the flow thereof. Therefore, even though there is a great pressure differential between well annulus 13 and the atmospheric pressure air in low pressure chamber 294 above shoulder 272, mandrel assembly will not move faster than oil can be forced into cavity 331 through metering device 370. It will be observed that the low pressure in chamber 294 will result in continued mandrel assembly movement even if pressure in well annulus 13 is reduced to hydrostatic, due to the continued, if lower, pressure differential, which is more than sufficient to move mandrel assembly 102.

When movement of mandrel assembly 102 occurs, it should be noted that inner shear support 332 moves with it, impelled by ledge 306 on mandrel 300. Outer shear support 334, quick slap connector 340 and metering cartridge 350 are restrained from movement by shoulder 218 of case 200. Grooves 314 on ledge 306 provide clear passage of oil from below to above ledge 306, despite the proximity of connector 340 during initial mandrel assembly movement and later outer shear support 334 and bore wall 216.

As mandrel assembly 102 moves upwardly in housing assembly 100, it creates an annular sample chamber 400 while substantially simultaneously trapping a fluid sample therein. Upon reaching protector sleeve 146, it moves same upwardly in bore 116 to shoulder 114, garter spring 158 expanding to permit the biasing of locking dogs 158 radially outwardly to thereby release sleeve 46, and apertures 154 preventing fluid lock between top coupling 104 and protector sleeve 146.

As sample chamber mandrel 260 moves upwardly past seal means 144, an annular sample chamber 400 is created and sealed between sample chamber case 130 and sample chamber mandrel 260. The inner radial extent of the chamber is shown for illustrative purposes by broken line 402 in FIGS. 2A and 2B. The chamber 400, of course, can be of any suitable length and capacity desired. The chamber 400 is sealed at its upper end by seal means 144 against cylindrical surface 270 on mandrel 260, and at its lower end by seals 170 against the same surface.

After shear pins 336 have sheared and sampler valve 18 has operated to trap a sample, no further operation of sampler valve 18 will result, even if pressure is relieved to hydrostatic, as noted previously, or the testing string 14 is pulled from the well bore. However, the full open bore of the sampler valve 18 is preserved even after the sample is trapped. Sample chamber mandrel 260 is locked into place via the action of locking dogs 156, which are biased into recess 264 on mandrel 260 by garter spring 158 when aligned therewith, subsequent downward movement of mandrel 260 be restrained by upper edge 266 of recess 264.

While sampler valve 18, as noted previously, may be placed above or below tester valve 17, the provision of a time delay feature permits the taking of a sample during a "closed-in" period while tester valve 17 is closed if sampler valve 18 is placed therebelow in testing string 14, a hitherto impossible task using a completely pressure-operated testing string. For instance, in taking a sample using the present invention, the well operator can increase well annulus pressure to open tester valve 17, establish flow through testing string 14, and continue to increase pressure to a level great enough to shear pins 336 in shear set 330, releasing mandrel assembly 102 to move inside housing assembly 100. Pressure can subsequently be reduced to hydrostatic in well annulus 13, closing tester valve 17. However, by using a suitable metering device 370 to regulate the flow of oil through metering cartridge 350, the sample trapping can be delayed in sampler valve 18 until well after tester valve 17 has closed. Metering devices 370 being freely interchangeable, mandrel movement can be retarded so as to trap a sample 5 minutes, 10 minutes, or up to several hours after tester valve 17 has closed.

Figure 3:
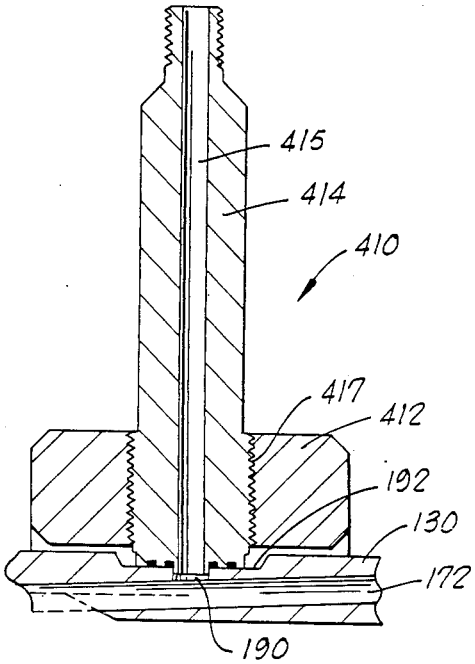
FIGS 3 and 4 comprise sectional elevations of a drain assembly for removal of fluid samples from the sampler valve of the present invention.
Figure 4:
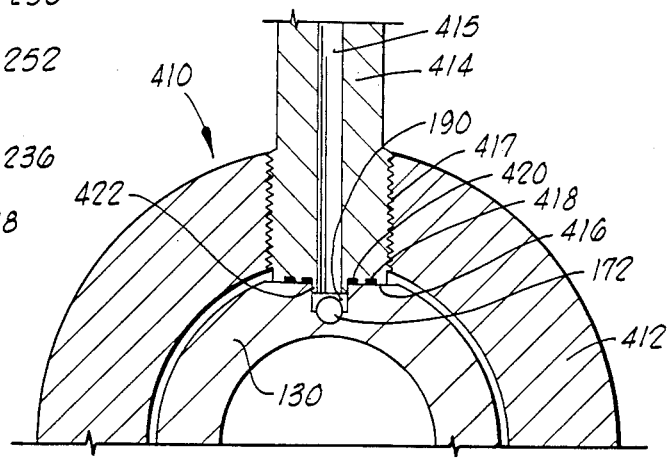

When testing string 14 is tripped out of the well bore, the fluid sample may be removed from sampler valve 18 on site or the upper section of valve 18 containing sample chamber 400 may be removed from the lower section thereof by backing off air chamber case 200 from sample chamber case 130 and oil chamber mandrel 300 from sample chamber mandrel 260, and the detached upper section transported to a laboratory or shop onshore for sample removal. In either case, when a fluid sample is to be removed from the sample chamber 400, sampler valve 18 is placed in a horizontal position and drain assembly 410 secured thereto. Drain assembly 410 (see FIGS. 3 and 4) comprises a drain doughnut 412 of greater inner diameter than housing assembly 100, with diametrically opposed drain nipples 414 having axial bores 415 (top nipple shown) threaded thereinto at 417. The inner ends 416 of nipples 414 are flat, and each contain concentric annular recesses in which O-rings 418 and 420 are disposed. Nipples 416 are aligned with flats 192 and drain ports 190 on sample chamber case 130 by annular flange 422 which protrudes from inner ands 416 into drain ports 190 when nipples 414 are fully threaded into doughnut 412. O-rings 418 and 420 are compressed against flats 192, forming a fluid-tight seal. Pressure lines and valves as are well known in the art are secured to the outer ends of drain nipples 414. It is preferred that nipples 414 be vertical in alignment, that is to say, one extending verticaly upwardly from horizontal sampler valve 18, and one vertically downwardly, during sample draining.

To drain the fluid sample, retainer collar 184 is backed off on threaded surface 188, the interior pressure in the sample usually pushing sample valves 174 out of bores 172. As soon as the last of O-rings 176 about each sample valve 174 moves past drain ports 190, the fluid sample will begin to flow into nipples 414 due to trapped pressure, which is thereby relieved by bleeding it off through a valve connected to the top nipple pressure line. To assure complete draining and capture of the fluid sample from the sample chamber, it is desirable to have a pump and a source of mercury sufficient to fill the sample chamber connected to the pressure line running to the bottom nipple. Mercury is then pumped into the sample chamber of sampler valve 18 through bottom nipple 414, and the fluid sample displaced upwardly into top nipple 414 by the heavier mercury.

It will thus be apparent to one of ordinary skill of the art that a novel and unobvious method and apparatus for taking fluid samples from a well has been invented. Numerous advantages previously alluded to, including the provision of a full bore of equal diameter with the rest of the tools in the string, an open bore after trapping of a sample, a time delay feature to permit delayed sample trapping, including trapping during a closed-in period during a test, contribute to the present invention's clear superiority over the prior art.

While the present invention has been disclosed in the form of a preferred embodiment, it will readily be apparent to one of ordinary skill in the art that many additions, deletions and modifictions to the preferred embodiment may be made without departing from the spirit and scope of the claimed invention.

I claim:

1. A downhole tool for trapping a fluid sample from a producing formation intersected by a well bore, comprising:

a housing assembly having an axial bore therethrough, a portion of said bore being of enlarged diameter;

a tubular mandrel assembly slidably disposed within said housing assembly and longitudinally movable from a first position removed from said enlarged diameter bore portion to a second position spanning said enlarged diameter bore portion and creating at said second position a longitudinally extending annular sample chamber defined substantially throughout its longitudinal extent between the exterior of said mandrel assembly and the interior wall of said enlarged bore portion; and initiation means for moving said mandrel assembly from said first to said second positions.

2. The downhole tool of claim 1, wherein said initiation means includes piston means responsive to pressure in said well bore.

3. The downhold tool of claim 2, wherein said initiation means further includes:

shear means shearable in response to the application of a predetermined magnitude of said well bore pressure.

4. The downhole tool of claim 3, wherein said initiation means further includes:

time delay means adapted to impede the movement of said mandrel assembly from said first to said second position after shearing of said shear means.

5. An annulus pressure responsive sampler valve having a substantially unrestricted axial bore therethrough, comprising:

a housing assembly including an enlarged axial bore portion and seal means at the upper and lower extents of said bore portion;

a tubular mandrel assembly slidably disposed in said housing assembly and axially movable from a first position removed from said enlarged bore portion to a second position spanning said enlarged bore portion and creating at said second position an axially extending annular sample chamber defined substantially throughout its axial extent between the exterior of said mandrel means and the interior wall of said enlarged bore portion while maintaining said substantially unrestricted axial bore through said sampler valve; and annulus pressure responsive initiation means including pressure responsive piston means, a low pressure chamber associated with said piston means, shear means shearable in response to a predetermined magnitude of said annulus pressure, and time delay means for impeding movement of said mandrel assembly, for moving said mandrel means from said first position to said second position.

6. The sampler valve of claim 5, wherein said shear means comprises a shear set disposed between said housing assembly and said mandrel assembly, said shear set comprising:

an inner shear support disposed about said mandrel assembly subject to axial loading thereby;

an outer shear support disposed about said inner shear support subject to axial loading by said housing assembly; and shear pins extending between said inner and outer shear supports.

7. The sampler valve of claim 5, wherein said time delay means comprises:

a fluid metering cartridge disposed between said housing and mandrel assemblies and having a cavity adjacent one side thereof and defining one end of a metering fluid-filled chamber adjacent the other side thereof;

a floating piston disposed at the other end of and defining that end of said fluid-filled chamber; and at least one power port through the wall of said housing assembly on the side of said floating piston opposite said fluid-filled chamber.

8. The sampler valve of claim 7, wherein said metering cartridge further includes:

a metering passage extending from said chamber to said cavity; and a fluid metering device disposed in said metering passage adapted to restrict flow of said metered fluid therethrough into said cavity.

9. The sampler valve of claim 5, wherein said piston means is part of said mandrel assembly in slidable sealing engagement with said housing assembly, said low pressure chamber is adjacent one side of said piston means and the other side of said piston means is exposed to said annulus pressure.

10. The sampler valve of claim 5, further including seal protector means adjacent said upper end seal means of said bore portion when said mandrel assembly is in said first position, and removed therefrom by said mandrel assembly when said mandrel assembly is in said second position.

11. The sampler valve of claim 10, wherein said protector means is a tubular sleeve maintained adjacent said upper end seal means by a radially-biased releasable locking means.

12. The sampler valve of claim 11, wherein said radially-biased releasable locking means secures said mandrel assembly in said second position.

13. The sampler valve of claim 5 further including sample drain means associated with said sample chamber, said sample drain means including:

at least one sample bore disposed in the wall of said housing assembly;

a sample valve disposed in said sample bore;

retainer collar means adapted to releasably retain said sample valve in said sample bore;

a drain port intersecting said sample bore and extending to the exterior of said housing assembly.

14. The sampler valve of claim 13, wherein said sample drain means includes two diametrically opposed sample bores in said housing assembly wall, each having a sample valve and a drain port associated therewith;

flats associated with and surrounding each of said drain ports; and a drain assembly disposed about said sampler valve including:

a drain doughnut surrounding said housing assembly; and drain nipples extending through and threaded to said drain doughnut to contact each of said flats. each of said drain nipples having a bore therethrough in communication with said drain ports and seal means surrounding each seal nipple bore at the point of contact with said flats.

15. A method of taking a fluid sample from a producing formation intersected by a well bore, comprising:

disposing a testing string including a sampler valve in said well bore;

axially flowing said producing formation through said testing string and said sampler valve; and substantially simultaneously creating an annular sample chamber in said sampler valve and trapping a sample of said producing formation flow therein while maintaining an open, substantially unrestricted axial bore through said sampler valve.

16. The method of claim 15, further including:

incorporating a tester valve above said sampler valve in said testing string;

opening said tester valve to axially flow said producing formation through said testing string;

closing said tester valve to stop said flow; and creating said sample chamber and trapping said sample after said tester valve has closed and said flow has stopped.

17. The method of claim 16, further including actuating said sampler valve in response to pressure in said well bore.

18. The method of claim 16 further including opening said tester valve in response to pressure in said well bore;

actuating said sampler valve in response to said pressure;

closing said tester valve in response to a change in said pressure; and delaying the creation of said sample chamber and the trapping of said sample until after said tester valve has closed.

19. The method of claim 18, further including the steps of:

reopening said tester valve after said closing thereof by changing said well bore pressure again; and flowing said producing formation through said testing string while retaining said trapped sample in said sampler valve.

* * * * *

UNITED STATES PATENT AND TRADEMARK OFFICE

CERTIFICATE OF CORRECTION

PATENT NO. : 4,665,983

DATED : May 19, 1987

INVENTOR(S) : Paul D. Ringgenberg

It is certified that error appears in the above-identified patent and that said Letters Patent is hereby corrected as shown below:

In column 8, line 54, delete "46" and insert --146-- therefor.

In column 9, line 54, delete "ands" and insert --ends-- therefor.

Signed and Sealed this

First Day of December, 1987

*Attest:*

DONALD J. QUIGG

*Attesting Officer*

*Commissioner of Patents and Trademarks*